United States Patent [19]

Iversen et al.

[11] Patent Number: 4,910,492

[45] Date of Patent: Mar. 20, 1990

[54] ELECTRIC LAMINAR RESISTOR AND METHOD OF MAKING SAME

[75] Inventors: Kristian Iversen, Sønderborg; Per G. Zacho, Nordborg, both of Denmark

[73] Assignee: Danfoss A/S, Nordborg, Denmark

[21] Appl. No.: 335,960

[22] Filed: Apr. 10, 1989

Related U.S. Application Data

[62] Division of Ser. No. 211,991, Jun. 27, 1988, Pat. No. 4,853,671.

[30] Foreign Application Priority Data

Jul. 8, 1987 [DE] Fed. Rep. of Germany ..... 3722576

[51] Int. Cl.[4] ..... H01C 1/012

[52] U.S. Cl. ..... 338/308; 29/610.1; 338/309

[58] Field of Search ..... 338/308, 307, 309, 322, 338/324, 325, 327, 338, 195; 29/610.1, 620, 621

[56] References Cited

U.S. PATENT DOCUMENTS

| | | | |
|---|---|---|---|
| 3,202,951 | 8/1965 | Krinsky | 338/332 X |
| 3,761,860 | 9/1973 | Ogasawara et al. | 338/309 X |
| 4,272,739 | 6/1981 | Nesses | 338/325 X |

*Primary Examiner*—C. L. Albritton

*Attorney, Agent, or Firm*—Wayne B. Easton; Clayton R. Johnson

[57] ABSTRACT

An electric laminar resistor and the method of making same wherein a thin metal film is applied to a ceramic substrate. Metal film material is removed to form a resistance track and recessed connecting zones at opposite ends of the track. A burnt-in thick layer paste is extended through the connecting zone recesses and solidified to form connecting elements that are adhered to the substrate. A glass frit coating is applied over the resistance track, but not over the connecting elements. The resistance of the resistor may be adjusted by separating a part of the track.

14 Claims, 2 Drawing Sheets

ELECTRIC LAMINAR RESISTOR AND METHOD OF MAKING SAME

RELATED APPLICATION

This application is a divisional application of application Ser. No. 211,991, filed June 27, 1988, now U.S. Pat. No. 4,853,671.

The invention relates to an electric laminar resistor in which a substrate carries a metal film which is provided with separating recesses and forms a resistance track with connecting zones at its ends, as well as to a method of making same.

Platinum laminar resistors are known by the designation Pt-100 or Pt-1000. These are employed particularly as temperature sensors having a high accuracy. To make them, a thin platimum film is applied by cathode sputtering to a common ceramic substrate. Thereafter, excessive material of the platinum film is etched away or burnt away with the aid of a laser beam to form meandering resistance tracks. Individual laminar resistors are obtained by severing the common substrate. Wires are connected to the connecting zones by means of thermocompression welding. By means of measurements between the connecting wires, the individual resistors can be sorted according to degree of accuracy or they can be adjusted such as by means of trimming with the aid of a laser beam.

In these laminar resistors, there is the danger that the connecting wires connected to the metal film will tear off. For this reason it is necessary to use a very pure ceramic substrate having a particularly smooth surface, namely an expensive so-called thin film substrate, so that the adhesion between the metal film and the substrate surface has a certain minimum value. In addition, one tries to secure the connecting wires mechanically by applying a coating of melted glass frit over the wire connections. The latter has the result that the individual laminar resistors have to be provided with the connecting wires by the manufacturer and transported in this condition.

The invention is based on the object of providing an electric laminar resistor of the aforementioned kind in which the danger of mechanical damage to the connections is much smaller.

This problem is solved according to the invention in that each connecting zone is provided with at least one connecting recess and a conductive connecting element contacts the metal film and is connected to the substrate by the connecting recess.

In this construction, the connecting element does not adhere to the substrate by way of the metal film. Instead, it adheres directly to the substrate surface because it passes through the connecting recess. This leads to a very high mechanical strength. Connecting wires can be joined to these connecting elements in conventional manner, for example by soldering. This need not be done by the manufacturer but can be done by the user. This simplifies production and transport.

It is favourable if each connecting zone is provided with a plurality of connecting recesses. This brings about a good mechanical fixing with reliable contacting of the metal film.

In particular, the connecting element is formed by a burnt-in thick layer paste. These thick layer pastes are known from thick layer technology and consist of a metal powder mixed with a glass frit powder and a carrier which can be of oil and solvents. Because of its consistency, such thick film paste results in good contacting of the metal film and of the substrate surface.

In a further form of the invention, the substrate is a ceramic thick layer substrate. In thick layer technology, cheaper ceramic substrates with more impurities and a rougher surface can be employed. There is less adhesion of the metal film as compared with a thin film substrate but this is permissible because the metal film is not stressed by the connecting wires. Conversely, a particularly good adhesion is obtained in conjunction with the thick layer paste. In this connection, it is favourable for the connecting recesses to be formed by small holes which remain during the application of the metal film to the thick layer substrate. Often these small holes, so-called pinholes, suffice to secure the connecting element properly to the substrate surface.

It is particularly recommended that the metal film be coated by a protective layer through which the connecting element passes. It protects the metal film from mechanical damage and becoming detached from the substrate but does not impede the free accessibility of the connecting elements. It can be of glass, a polymer or some other suitable material.

A method of making such a laminar resistor in which a metal film is applied to a substrate, particularly by cathode sputtering, and separating recesses are subsequently formed by the removal of material is characterised in that connecting recesses are produced in the connecting zones and a paste-like connecting mass is applied in the connecting zones onto the metal film as well as through the recesses onto the substrate and then solidified to form a connecting element.

To produce the connecting recesses, one can employ the same means as those already used for the separating recesses. In particular, the connecting recesses can be produced simultaneously with the separating recesses. The paste-like connecting mass ensures a contact to the desired surfaces.

Preferably, the connecting mass contains a glass frit in addition to a metal powder and is solidified by firing. Such processes are known from thick layer technology.

Further, the connecting mass should be applied by screen printing. This is a rational process, especially when the individual resistance tracks are still disposed on a common substrate.

If the resistance is adjusted by the additional removal of material, adjustment should be effected only after the application and solidification of the connecting mass. The changes in resistance possibly brought about by the connecting mass can then be taken into account during adjustment.

It is also favourable if, after solidification of the connecting mass or after adjustment, a glass frit is applied beyond the connecting mass and then melted to form a glass coating.

Preferred examples of the invention will now be described in more detail with reference to the drawing wherein:

FIG. 4 is a plan view of a modified part of the laminar resistor of

FIG. 1.

Figure 1:
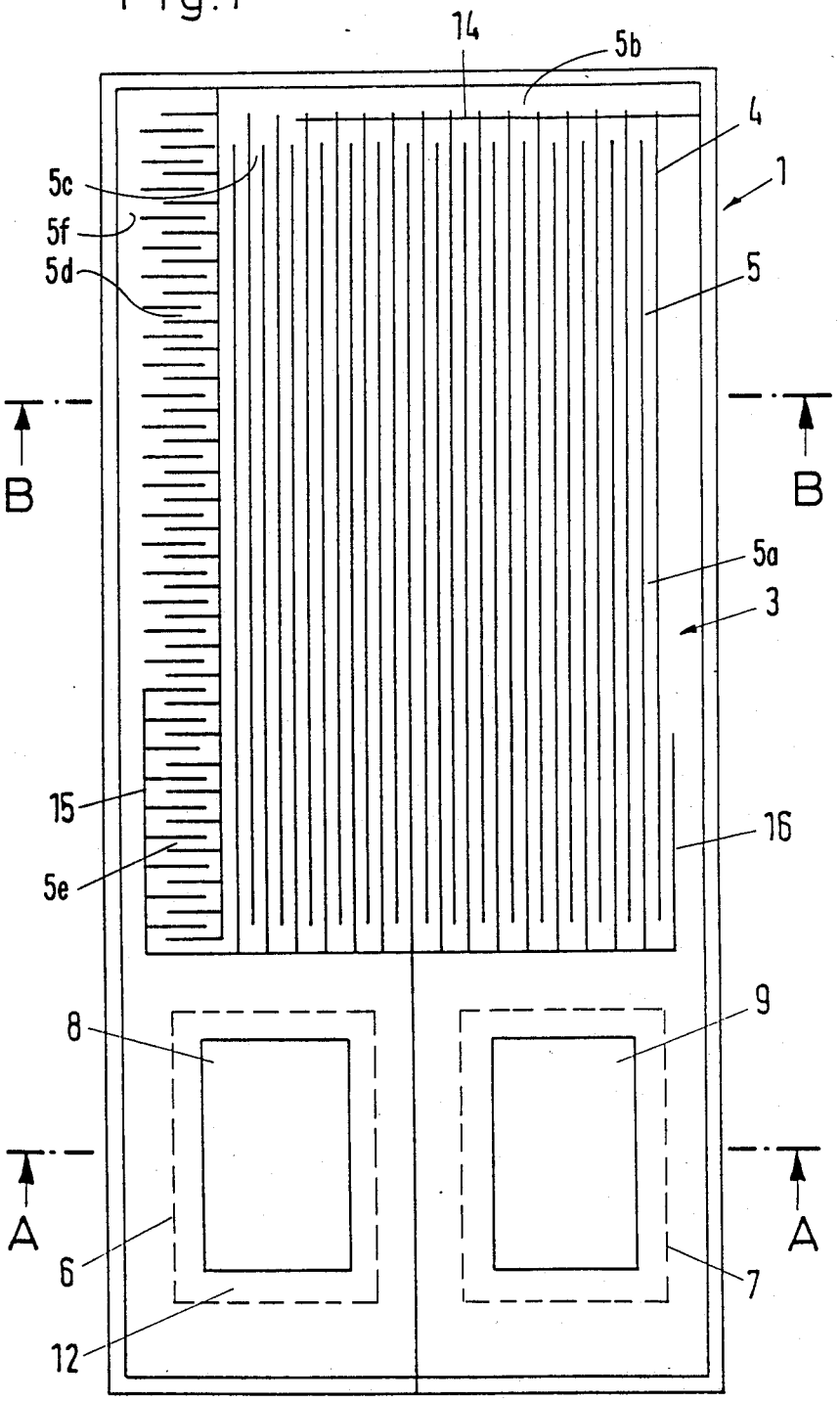
FIG. 1 is a plan view of a laminar resistor according to the invention before application of the connecting elements.
Figure 2:
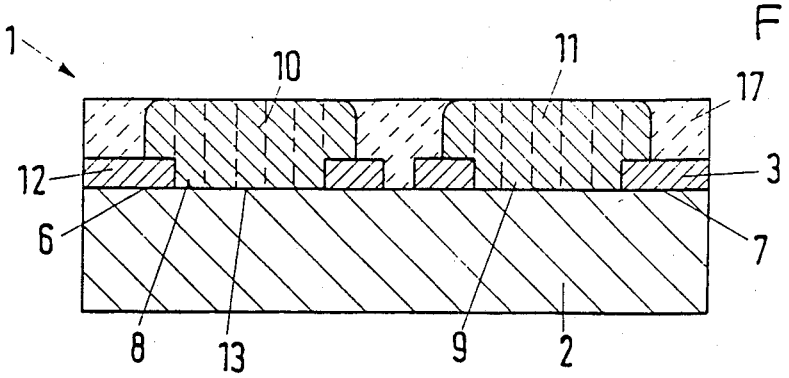
FIG. 2 is a diagrammatic cross-section of the finished laminar resistor taken on the line A–A in FIG. 1.
Figure 3:
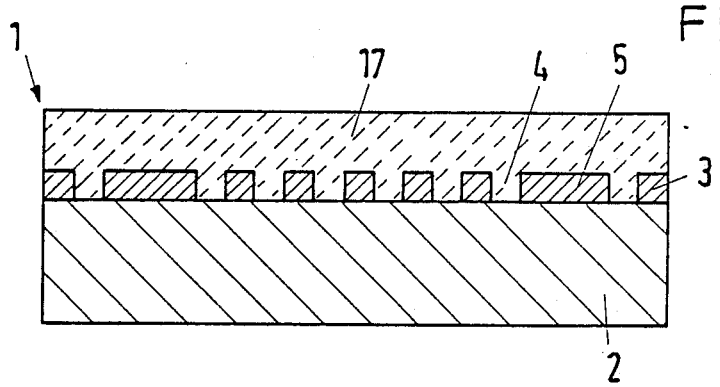
FIG. 3 is a diagrammatic cross-section of the finished laminar resistor taken on the line B–B in FIG. 1.

FIGS. 1 to 3 illustrate an electric laminar resistor 1. It consists of a substrate 2 of ceramic. In the present case, it is formed as a thick layer substrate with 96% $Al_2O_3$, the remainder being impurities such as $SiO_2$, MgO and the like.

A thin metal film 3, in this case a platinum film, is applied to this substrate. Application was by means of cathode sputtering. However, any other manner of applying thin films can be employed.

Thereafter, material was removed from the metal film 3 at numerous linear separating recesses 4. These separating recesses are here shown as simple lines. This resulted in a meandering resistance track 5. Two connecting zones 6 and 7 are provided at its ends. In these zones, a respective connecting recess 8 and 9 is produced by the removal of material. The material of the separating recesses 4 and the connecting recesses 8 and 9 was undertaken in one operation by burning away with the aid of a laser beam. However, it can also be removed by etching or in some other manner.

Connecting elements 10 and 11 cover the connecting zones 6 and 7. They contact the metal film 3 at a marginal zone 12 and engage through the connecting recesses 8 and 9 where they contact the surface 13 of the substrate 2. These connecting elements are applied in the form of a thick film paste by screen printing or in some other way and are subsequently fired. This thick film paste consists of a metal powder, particularly a silver palladium or gold palladium mixture, a glass frit powder and a carrier which, for example, consists of ethylcellulose dissolved in pine oil derivatives and phthalate esters. Smaller amounts of castor oil derivatives and a phospholipide may also be present. Such pastes are marketed by Messrs. Dupont under Type No. 9308 and 9572.

The thick film paste is subsequently fired in a through-type furnace. The temperatures may, for example, be between 750° C. and 950° C.

Subsequently, the laminar resistor is adjusted. This takes place in that the resistor is connected to a measuring device by way of the connecting elements 8 and 9. Two coarse adjustment separating lines 14 and 15 as well as a fine adjustment separating line 16 are then drawn to the appropriate length until the precise resistance has been achieved. By separating a track with the aid of the separating line 14, one can obtain, say, an increase in resistance of 50 ohm and by separating a track with the aid of the separating line 15 an increase in resistance of, say, 2 ohm. A linear change in resistance can be obtained by the separating line 16.

As may be seen from FIG. 1, a plurality of longitudinally elongated first track sections 5*a* are separated from the transverse track section 5*b* by the separating line 14 while other track section 5*c* are joined to the track section 5*b*. Similarly several of the transverse track sections 5*e* are separated from the longitudinal track section 5*f* by line 15 while other transverse track sections 5*d* are not separated from the longitudinal section 5*f*.

Subsequently, a protective layer 17 is applied over the entire surface but leaving the connecting elements 10 and 11. This takes place by applying a glass frit which is subsequently melted. The manufacturer or, later, the user can solder the connecting wires onto the remaining surfaces of connecting elements. Application of the wires can also be by welding.

Figure 4:
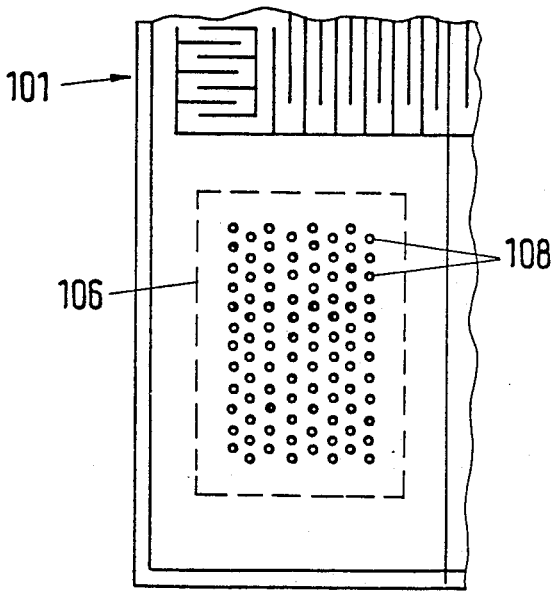

FIG. 4 shows a modified laminar resistor 101 of which the connecting zone 106 is provided not with a single recess 8 but a plurality of small holes 108. These pinholes often occur by themselves when the metal film is applied to the rough surface of the thick layer substrate.

It may be mentioned that, during manufacture, a large common substrate plate is used on which a plurality of resistance tracks with associated connecting elements is produced simultaneously. Only after finishing are the individual laminar resistors separated from each other by cutting the common substrate.

We claim:

1. A method of making an electric laminar resistor that has a substrate made of an electrical non-conductive material, an electrically conductive film that has separating recesses to form a resistance track that includes a first and a second end and a first and a second connecting zone connected to the track first and second end respectively with each zone having at least one connecting recess that opens to the substrate, and a first and a second conducting element connected to the first and second zone respectively, the first and second conductive element having a portion extended through the first and second connecting recess respectively and adhered to the substrate, the steps of applying the metal film to the substrate, removing material from the metal film to form the separating recesses and connecting recesses, applying a paste-like connecting mass at the connecting recesses onto the metal film and through the connecting recesses onto the substrate, and thence solidifying the mass to form the connecting elements in adhered relationship to the substrate.

2. The method according to claim 1, characterized in that the separating recesses and the connecting recesses are formed at the same time.

3. The method according to claim 1, characterized in that the connecting means comprises glass frit and a metal powder, and that the solidifying step comprises firing in a furnace.

4. The method according to claim 1, characterized in that the connecting elements are applied by screen printing.

5. The method according to claim 1, characterized in that the resistance of the resistor is adjusted by removal of metal film material after the application and solidification of the connecting elements.

6. A method of making an electric laminar resistor, the steps of applying an electrically conductive film to a substrate made of an electrical non-conductive material, removing film material from the substrate to provide separating recesses for forming a meandering resistance track having a first end portion and a second end portion and first and second connecting recesses that open through the first and second end portion respectively to the substrate and thence applying a paste-like connecting mass at the connecting recesses onto the track first and second end portion and through the connecting recesses onto the substrate, and thence solidifying the mass to form connecting elements in adhered relationship to the substrate.

7. The method of claim 6 wherein a protective layer is applied to adhered to the substrate and cover and conductive film.

8. The method of claim 6 further characterized in that the mass comprises a glass frit and metal powder and that the solidifying step comprises heating the mass.

9. The method of claim 6 further characterized in that the step of adjusting the resistance after solidifying the mass by removal of a part of the track between the connecting elements.

10. The method of claim 6 further characterized in that the step of applying the paste-like mass comprises application by screen printing.

11. The method of claim 6 further characterized in that the step of removing material includes forming the separating recesses to provide to form separated first track sections and a second track section with at least one of the first track sections joined thereto, and after forming the connecting elements, forming a separating line in the metal film that intersects at least one of the track sections to adjust the resistance of the meandering track between the first and second end portions of the track.

12. The method of claim 11 further characterized in that the step of forming the separating line includes forming the line to increase the resistance of the meandering track between the connecting elements.

13. The method of claim 11 further characterized in that the step of forming the separating line includes forming the line to decrease the resistance of the meandering track between the connecting elements.

14. The method of claim 6 further characterized in that the substrate is ceramic.

* * * * *